United States Patent [19]

McCabe

[11] Patent Number: 4,494,449

[45] Date of Patent: Jan. 22, 1985

[54] INSULATED LAY-IN DIFFUSER

[76] Inventor: Francis J. McCabe, 239 Hastings Ct., Doylestown, Pa. 18901

[21] Appl. No.: 360,804

[22] Filed: Mar. 22, 1982

[51] Int. Cl.[3] ..... F24F 13/00

[52] U.S. Cl. ..... 98/40.05; 98/40.13

[58] Field of Search ..... 98/1, 40 R, 40 D, 40 DL

[56] References Cited

U.S. PATENT DOCUMENTS

| | | | |
|---|---|---|---|
| 2,148,530 | 2/1939 | Burke | 98/33 |
| 3,009,473 | 11/1961 | Hennen . | |
| 3,259,052 | 7/1966 | Bradley et al. | 98/40 DL |
| 3,337,991 | 8/1967 | Adams | 49/3 |
| 3,406,623 | 10/1968 | Lambert | 98/40 |
| 3,411,425 | 11/1968 | Lambert | 98/40 |
| 3,580,238 | 5/1971 | Diehl | 126/295 |
| 3,592,240 | 7/1971 | Hedrick et al. | 137/316 |
| 3,785,272 | 1/1974 | McNabney et al. | 98/40 D |
| 4,146,048 | 3/1979 | McCabe | 137/75 |
| 4,210,070 | 7/1980 | Tatum et al. | 98/40 D |
| 4,241,748 | 12/1980 | McCabe | 137/77 |
| 4,263,930 | 4/1981 | McCabe | 137/80 |
| 4,380,188 | 4/1983 | Nichols | 98/40 D |

FOREIGN PATENT DOCUMENTS

| | | |
|---|---|---|
| 2307228 | 5/1976 | France . |
| 2316513 | 1/1977 | France . |

OTHER PUBLICATIONS

Trade Literature entitled "Options and Accessories", relating to the ETL® Electro Thermal Link distributed by Air Balance Inc.

*Primary Examiner*—Harold Joyce

*Attorney, Agent, or Firm*—Benasutti and Murray

[57] ABSTRACT

An insulated lay-in diffuser comprising a housing having a shaped surface including a substantially centrally disposed collar and terminating at a mounting flange, and insulation material positioned on the shaped surface and extending between the collar and flange of the housing.

3 Claims, 8 Drawing Figures

INSULATED LAY-IN DIFFUSER

BACKGROUND OF THE INVENTION

This invention relates generally to lay-in diffusers, and more particularly, to an insulated lay-in diffuser which is capable of resisting heat transfer.

In many constructions, suspended ceiling systems are used to finish a permanent structure which has been formed. Such suspended ceiling systems generally include a network of runners which are suspended from the permanent structure to form a desired pattern, and a plurality of corresponding ceiling panels which are positioned over and between the array of runners to provide a finished appearance.

Often, a number of components are located within the space defined between the suspended ceiling system and the permanent structure to which it is attached. This would include duct work for any air conditioning and heating systems which are to be provided. To permit communication between this duct work and the area located beneath the suspended ceiling, lay-in diffusers are often provided which are capable of resting upon and extending between the array of runners used to support the ceiling panels in position. Such diffusers generally include finished bottom portions provided with appropriate ventilating structures, and duct drops are generally provided to connect the duct work with those lay-in diffusers which are being used to ventilate an area.

Although such systems are easy to install and provide adequate operational capabilities, such systems can present certain problems in relation to the field of fire protection. For example, ceiling panels are available which are capable of providing a suitable barrier between the spaces located above and below the suspended ceiling system. Also available are a number of damper assemblies which can provide such a capability. For example, reference is made to those damper constructions described and illustrated in my U.S. Pat. No. 4,146,048, dated Mar. 27, 1979; U.S. Pat. No. 4,241,748, dated Dec. 30, 1980; U.S. Pat. No. 4,263,930, dated Apr. 28, 1981; and the damper construction disclosed in my U.S. patent application Ser. No. 117,125 abandoned, filed Jan. 31, 1980, the subject matter of each of which is incorporated by reference as if fully set forth herein. However, difficulties are still encountered in obtaining a diffuser which is fully capable of withstanding the conditions presented by a fire, hampering the development of a fully fire-rated ceiling system.

It therefore remains desirable to develop a lay-in diffuser which is capable of resisting the effects of a fire, and which therefore permits the development of a suspended ceiling system which is fully fire-rated.

SUMMARY OF THE INVENTION

In accordance with the present invention, a lay-in diffuser is provided which is adapted for use in conjunction with conventional suspended ceiling systems and which includes insulation means capable of presenting a barrier to the propagation of fire conditions. In the preferred embodiment, a conventional lay-in diffuser including a centrally disposed neck and a peripheral housing terminating in a flange capable of engaging the runners of the suspended ceiling system is provided with insulation material applied to the diffuser housing. This insulation material may be applied to the housing in various ways, including direct application to the material forming the surface of the housing, or to dimples associated with the housing surface to form air gaps between the housing surface and the insulation material used. Also provided are additional plates which may be used in conjunction with conventional diffuser constructions to provide additional air spaces if desired.

It is therefore a primary object of the present invention to provide a lay-in diffuser which is resistant to fire conditions.

It is also an object of the present invention to provide a lay-in diffuser having surfaces which are insulated against fire conditions.

It is also an object of the present invention to provide an insulated lay-in diffuser which is suitable for use in conjunction with conventional suspended ceiling systems, and conventional duct work.

It is also an object of the present invention to provide an insulated lay-in diffuser which is capable of use in conjunction with available damper constructions.

It is also an object of the present invention to provide an insulated lay-in diffuser which is both simple in construction and easy to use.

These and other objects will become apparent from the following detailed description, taken in conjunction with the following illustrations.

BRIEF DESCRIPTION OF THE DRAWINGS

In the several views provided, like reference numerals denote similar structure.

DETAILED DESCRIPTION OF THE PREFERRED EMBODIMENTS

Although specific forms of the invention have been selected for illustration and the following description is drawn in specific terms for the purpose of describing these forms of the invention, this description is not intended to limit the scope of the invention which is defined in the appended claims.

Figure 1:
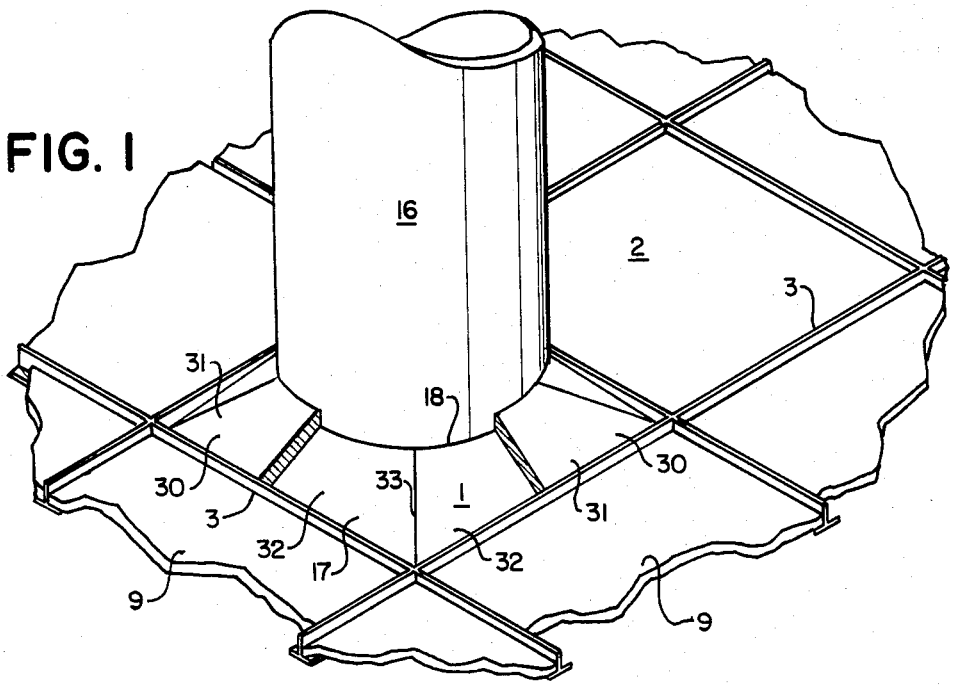
FIG. 1 is a perspective view illustrating an insulated lay-in diffuser of the present invention and its manner of use in conjunction with a conventional suspended ceiling system.
Figure 2:
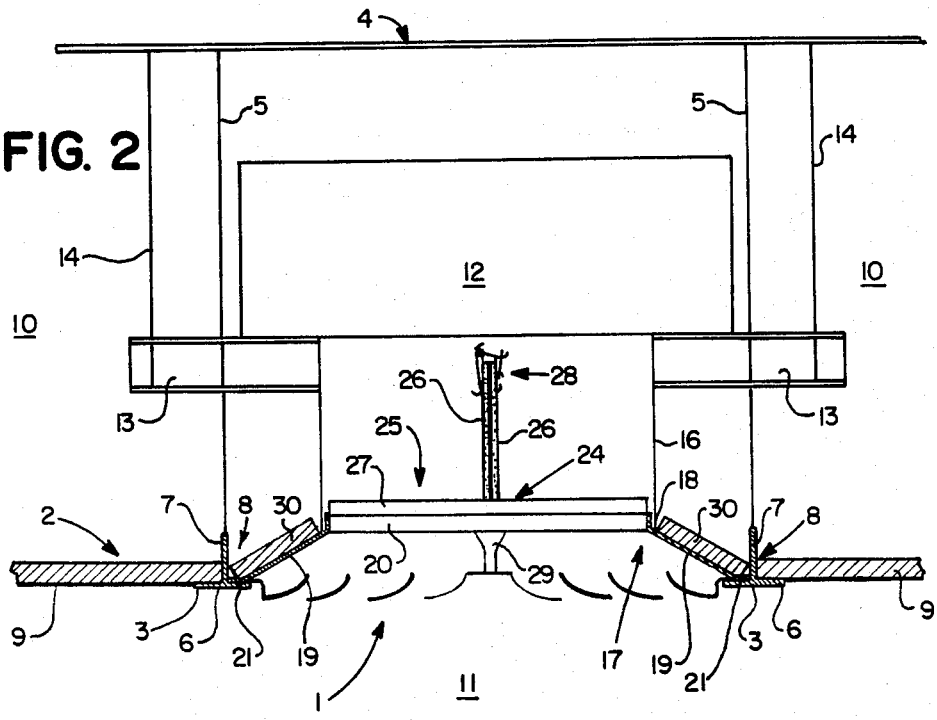
FIG. 2 is a partial, cross-sectional view of the insulated lay-in diffuser illustrated in FIG. 1, and its manner of use in conjunction with a suspended ceiling system and duct work located above the suspended ceiling system.

FIGS. 1 and 2 illustrate a first alternative embodiment lay-in diffuser 1 of the present invention, and its manner of use in conjunction with a suspended ceiling system 2. As illustrated, the framework for the suspended ceiling system 2 generally comprises a number of runners 3 suspended from a permanent structural element 4 forming part of the construction utilizing a series of hangers, such as the hanger wires 5 illustrated. Each runner 3 preferably comprises a horizontal section 6, and a vertical section 7 extending outwardly from mid-portions of the horizontal section 6. In this manner, the segments 6, 7 combine to provide two bracketed enclosures 8 capable of engaging ceiling tiles 9 as shown, and the vertical segment 7 provides a means for engaging the hanger wires 5. After assembling the array of runners 3, the ceiling tiles 9 are positioned within the bracketed enclosures 8, between respective runners 3 as indicated, providing a suspended ceiling system of conventional construction.

Traditionally, the cavity 10 defined between the suspended ceiling system 2 and the structural element 4 is used to contain components used in servicing the area 11 located beneath the suspended ceiling system 2. As illustrated in FIG. 2, this may include duct work 12 used in providing heating or air conditioning for example. Often, such duct work 12 is suspended from the structural element 4 using a system of supporting channels 13 which are suspended from the structural element 4 using the hanger wires 14 illustrated, in a manner similar to that used to support the channels 3 in position to form the suspended ceiling. The hanger wires 14 serve to support the channels 13 beneath the structural element 4 so that the duct work 12 can then be positioned over the channels 13, properly maintaining the duct work 12 in position over the suspended ceiling system 2. At desired intervals selected in accordance with recognized building practices, it becomes necessary to provide a means for communication between the duct work 12 and the area 11 located beneath the suspended ceiling system 2. This is conventionally accomplished by providing a duct drop 15 which extends between the duct work 12 and the body 17 of the diffuser 1. Such duct drops 15 generally include a segment 16 formed of a duct material and attached to and depending from an opening provided in the duct work 12. Alternatively, flexible duct materials may be used to form the segment 16, if desired. The terminating end 18 of the segment 16 communicates with the body 17 of the diffuser 1, and in turn, the area 11 located beneath the suspended ceiling system 2. In this manner, a means of communication is established between the duct work 12 and the area 11 located beneath the suspended ceiling system 2.

As illustrated, the diffuser body 17 generally comprises a housing 19, the central portions of which include a neck 20 and the terminating edge portions of which are provided with a perimeter 21. It will be readily understood that the overall configuration of the housing 19, neck 20 and perimeter 21 may be freely varied to suit a particular construction application.

For example, the periphery of the housing 19 illustrated in FIGS. 1 and 2 is flangeless, substantially square, and is generally sized for location between respective runners 3 forming the suspended ceiling system 2. In this manner, the housing 19 is capable of direct use in conjunction with the suspended ceiling system 2, for example, in place of one of the ceiling tiles 9. No additional mounting structure is required in such applications. Clearly, the configuration of the periphery of the housing 19 would vary to accomodate the runners 3 used. In such cases, the dimensions of the housing 19 could be suitably altered, or a flanged perimeter 21 could be provided if indicated.

The neck 20 of the housing 19 illustrated in FIGS. 1 and 2 is round and includes a ring portion or member 22 having a flange portion or member 23 extending inwardly from the ring 22 as shown. The ring 22 and flange 23 combine to provide a means for retaining a damper assembly 24 in position as shown, and also serve to engage the terminating end 18 of the segment 16 which communicates with the duct work 12. In this manner, the diffuser body 17 is provided with an opening 25 which permits the flow of air from the duct work 12 into the area 11 subject to operation of the damper assembly 24. Under normal operating conditions, the damper assembly 24 will be maintained in the open position illustrated in FIGS. 1 and 2 (the blades 26 assuming their open position) using a suitable restraining means such as the fusible link assembly 28 illustrated. However, in the event of a fire, the fusible link assembly 28 will become separated so that the blades 26 can close, substantially sealing the opening 25 provided in the diffuser body 17. For further details regarding the operation of such dampers, reference is made to my U.S. Pat. No. 4,146,048 for example. Further, if desired, a volume control mechanism 29 may be provided to regulate air flow through the damper assembly 24. For further details regarding the operation of such equipment, reference is made to my U.S. Pat. No. 4,263,930 for example.

As previously indicated, both the ceiling tiles 9 and the damper assembly 24 are available in forms which are capable of withstanding the conditions presented by a fire. However, conventional diffuser constructions generally are not, providing a weak link in the fire protection capabilities available from existing suspended ceiling systems. In accordance with the present invention, insulation material 30 is applied to the housing 19 of the diffuser body 17 to overcome this deficiency.

For example, as illustrated in FIGS. 1 and 2, shaped segments 31 formed of an appropriate insulation material 30 are applied directly to the housing 19 forming the diffuser body 17, developing an insulated area between the neck 20 and flange 21 of the diffuser body 17. In the embodiment illustrated, the housing 19 comprises four substantially trapezoidal segments 32 which extend between the neck 20 and flange 21 of the diffuser body 17 and which intersect along the seams 33. Clearly, such a housing 19 may be formed in a variety of ways from a variety of different materials. Irrespective of the manner in which the diffuser body 17 is formed, the segments 31 of insulation material are placed in position over the segments 32 of the housing 19 as shown. For convenience, the segments 31 of insulation material may either be loosely laid in position over the segments 32 of the housing 19, or if preferred, may be directly attached to the segments 32 using adhesives or appropriate hardware.

A variety of different materials may be used to form the segments 31. For example, those materials which are traditionally used to form the ceiling tiles 9 may be used for this purpose. In fact, actual ceiling tiles 9 may be used if desired, after being appropriately cut to size. The use of mineral board, such as gypsum board, has also been found to be particularly suitable in resisting fire conditions.

Providing the diffuser body 17 with insulation material 30 affords advantages both during normal operating conditions and during fire conditions. For example, during normal operating conditions the blades 26 of the damper assembly 24 will be open, allowing heated or cooled air to flow from the duct work 12 to the area 11 in the conventional manner. In such case, the material forming the ceiling tiles 9 of the suspended ceiling system 2 and the segments 31 of insulation material combines to insulate the area 11 from the cavity 10 located between the suspended ceiling system 2 and the structural element 4, assisting in the reduction of costs associated with heating or cooling the area 11. During fire conditions, the blades 26 of the damper assembly 24 will be closed. In such case, the segments 31 of insulation material, together with the material forming the ceiling tiles 9 and the damper assembly 24, provide a suitable barrier against the propagation of fire and/or heat from the area 11 to the cavity 10, materially reducing the potential for spread of the fire to other areas of the building and the potential for damage to components located above the suspended ceiling system 2. It may therefore be seen that the insulated lay-in diffuser 1 of the present invention is well suited to satisfying the several objectives previously set forth. It will also be understood that such lay-in diffusers are capable of modification to suit a wide variety of applications.

Figure 3:
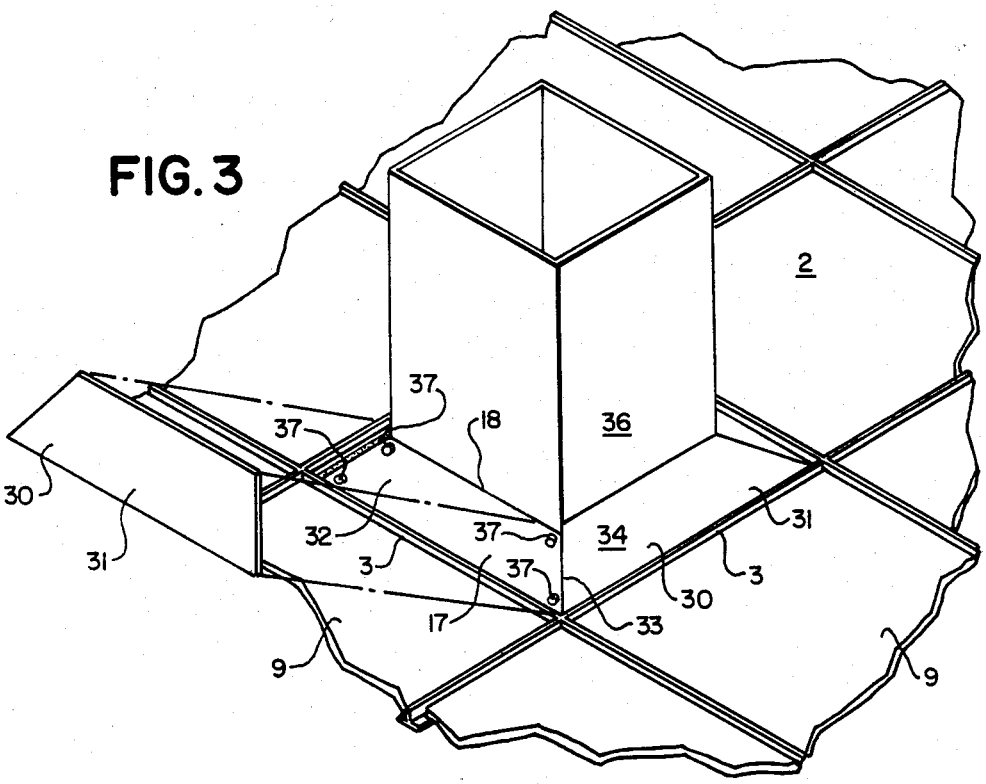
FIG. 3 is an exploded perspective view illustrating an alternative embodiment insulated lay-in diffuser of the present invention.
Figure 4:
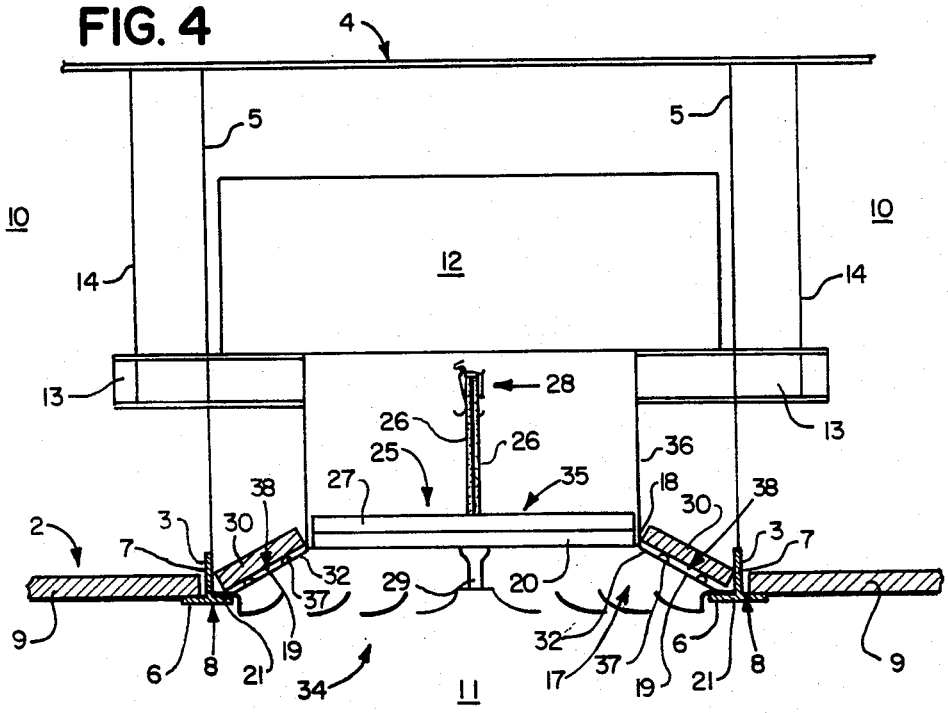
FIG. 4 is a cross-sectional view of the alternative embodiment insulated lay-in diffuser illustrated in FIG. 3.

For example, FIGS. 3 and 4 illustrate one such alternative embodiment diffuser 34. As shown, the diffuser 34 substantially structurally corresponds to the diffuser 1 illustrated in FIGS. 1 and 2, as does its manner of installation and use. However, two distinctions are noteworthy.

As a first distinction, the neck 20 of the diffuser body 17 is no longer round, as shown in FIGS. 1 and 2, but rather is substantially square in cross-section. Of course, this would involve a suitable modification of the damper assembly 35 which is selected for use in conjunction with the diffuser 34, as well as the segment 36 which provides communication between the duct work 12 and the diffuser body 17. Although different in appearance, the operation of these components will proceed substantially as previously described.

As a second distinction, it should be noted that each segment 32 of the housing 19 has been provided with a series of protrusions, such as the dimples 37 illustrated. In the embodiment shown, a series of four regularly spaced dimples 37 is associated with each segment 32. However, clearly, the placement of the dimples 37 on the segments 32 may be varied as desired. As previously described, the segments 31 of insulation material are laid in place over the dimples 37, and if desired, may be directly attached to the dimples 37 using a adhesive or appropriate hardware. As is best illustrated in FIG. 4, these dimples 37 serve to space the segments 31 of insulation material away from the housing 19, forming an air space 38 between these two components. The width of the air space 38 is readily varied by altering the thickness of the dimples 37. Providing a diffuser 34 with air spaces 38 has been found to materially improve the insulation capabilities afforded, still further enhancing the ability of the diffuser 34 to resist fire conditions.

For convenience, it is preferred that the dimples 37 be formed as part of the segments 32 since this operation is readily performed during formation of the diffuser body 17. However, it is also possible to use separate spacer elements to provide this capability. Such spacers could be installed during manufacture of the diffuser 34, or could be installed at the work site as indicated. For example, such spacer could be bonded to the housing 19 or the segments 31 of insulation material using an appropriate adhesive or mechanical fastener. Clearly, it is preferred that such spacers, if used, should be formed of a material which is sufficiently resistant to fire conditions to preserve the air spaces 38 developed between each segment 31 of insulation material and each segment 32 of the housing 19. Again, the width and location of such spacers may be varied as needed.

As discussed in conjunction with the diffuser 1 illustrated in FIGS. 1 and 2, a variety of different insulation materials may be used to form the segments 31 which are applied over the body 17 of the diffuser 34. Again, conventional ceiling tiles 9 or segments of mineral board may be used for this purpose, after being appropriately cut to size. For example, the use of appropriately sized $\frac{5}{8}$ inch ceiling tiles has been found to be suitable for this purpose. The use of $\frac{1}{2}$ inch mineral (gypsum) board in conjunction with air spaces of approximately 0.135 inches has also been found to be particularly suitable. Of course, other combinations may be developed as indicated for a particular application.

Figures 5, 6, 7, 8:
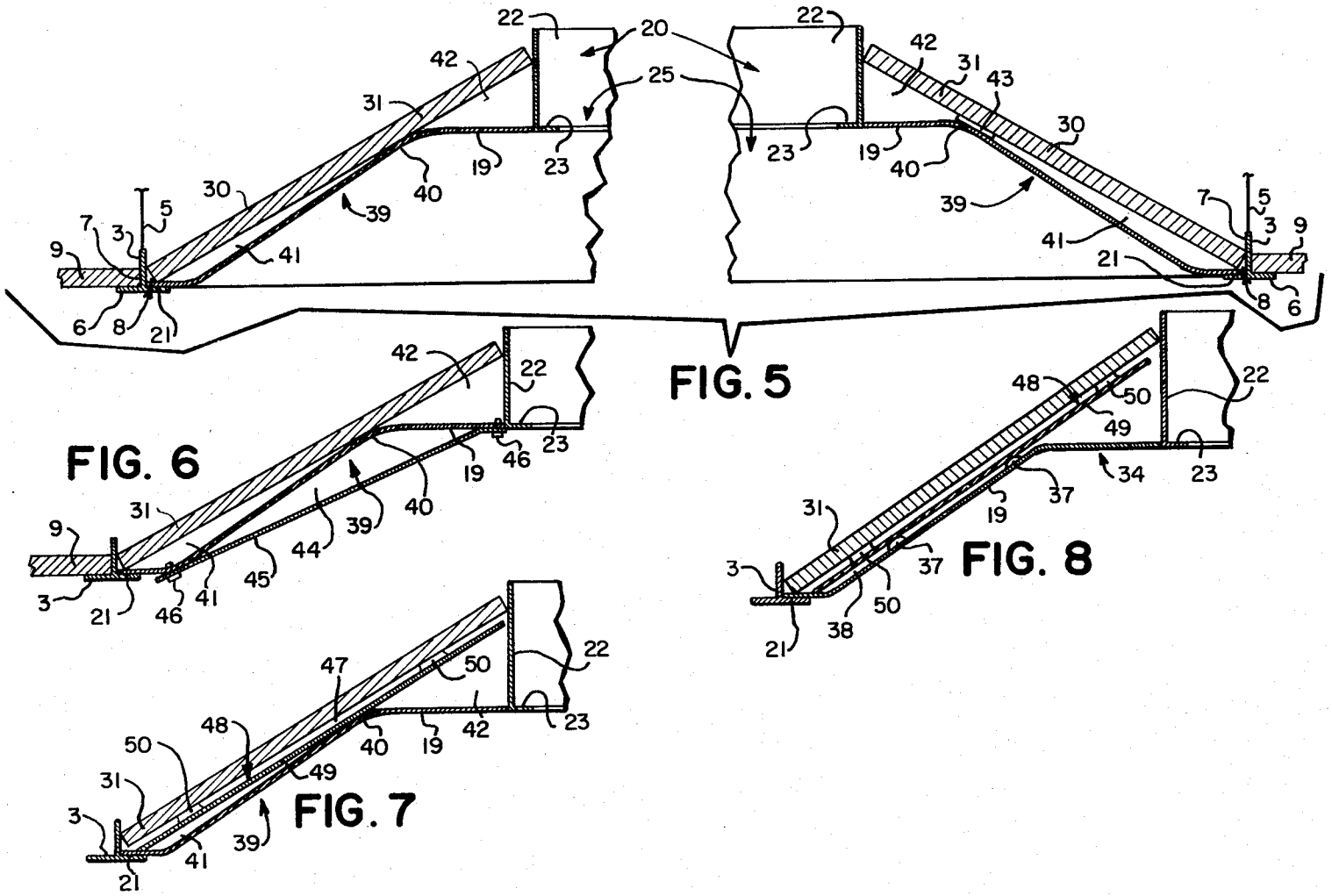
FIG. 5 is a cross-sectional view of a further alternative embodiment insulated lay-in diffuser.
FIGS. 6 to 8 are partial, cross-sectional views of further alternative embodiment insulated lay-in diffusers.

As previously mentioned, the diffusers 1, 34 each comprise four substantially flat segments 32 which combine to form a pyramid shaped diffuser body 17. However, it is to be understood that this shape is merely illustrative and that the overall shape of the diffuser body 17 is capable of variation without departing from the present invention. FIGS. 5 to 7 illustrate one such alternative configuration and its manner of use in conjunction with the present invention. As previously, the diffuser body 39 extends between a neck 20 and perimeter 21 (flanged or flangeless), and is associated with the duct work 12 in the same manner as was the diffuser body 17. However, in the present example, a contoured diffuser body 39 is provided which serves to develop a generally conical configuration.

It will be noted that the contour of the diffuser body 39, rather than defining a substantially flat surface, defines a curved surface including at least one node point 40. As illustrated in FIG. 5, such structure is particularly well suited to receiving segments 31 formed of insulation material as previously described. After appropriately shaping the segments 31, each is placed in position over the diffuser body 39 as illustrated, support for each segment 31 being provided by the perimeter 21 and the node point 40 associated with the diffuser body 39. In this manner, air spaces 41, 42 are developed between the diffuser body 39 and the segments 31 of insulation material, providing the benefits previously discussed in conjunction with the air spaces 38. As before, the segments 31 of insulation material may be applied to the diffuser body 39 either by laying the segments 31 in position as shown, or by directly attaching the segments to the perimeter 21 and/or node point 40 using an adhesive or appropriate hardware. Clearly, the size and configuration of the air spaces 41, 42 may be varied by altering the contour of the diffuser body 39, or if preferred, by positioning spacers 43 at the node points 40 (or elsewhere) as desired.

As illustrated in FIGS. 6 and 7, additional air spaces may be developed if indicated for a particular application. For example, in FIG. 6, an additional air space 44 is established by attaching a cover plate 45 to the diffuser body 39 as shown using appropriate hardware, such as the sheet metal screws 46 illustrated. In FIG. 7, an additional air space 47 is developed by placing a spacing plate 48 between the diffuser body 39 and the segments 31 of insulation material. In this manner, the base 49 of the spacing plate 48 is capable of resting between the flange 21 and node point 40 of the diffuser body 39, while a series of dimples 50 associated with the base 49 serve to space the segments 31 of insulation material from the base 49 of the spacing plate 48. As with the segments 31 of insulation material, the spacing plate 48 may be laid in position over the diffuser body 39, or may be directly attached to the diffuser body 39 using an adhesive or appropriate hardware. As illustrated in FIG. 8, it is also possible to use the spacing plate 48 in conjunction with the diffuser 34 illustrated in FIGS. 3 and 4. To do so, the spacing plate 48 is placed on the dimples 37 of the diffuser body 17 so that the base 49 contacts the dimples 37. The dimples 50 of the spacing plate 48 develop an additional air space 47 between the spacing plate 48 and the segments 31 of insulation material. Lastly, it should be noted that the spacing plate 48 may also be used in conjunction with the diffuser 1 illustrated in FIGS. 1 and 2 to develop air spaces similar to those developed in conjunction with the diffuser 34 of FIGS. 3 and 4.

It will therefore be understood that various changes in the details, materials and arrangement of parts which have been herein described and illustrated in order to explain the nature of this invention may be made by those skilled in the art within the principle and scope of the present invention as expressed in the following claims.

What is claimed is:

1. A diffuser means for interfacing a duct with an area to be serviced by the duct, the diffuser means comprising:

(a) a housing having a shaped, contoured surface and including a substantially centrally disposed collar for engaging portions of the duct and terminating edge portions for interfacing with the area to be serviced;

(b) insulation means positioned on the shaped surface and extending between the collar and the terminating edge portions of the housing;

(c) wherein the contoured surface is a curvilinear surface including at least one node point located intermediate the collar and the terminating edge portions of the housing;

(d) spacing plate means interposed between the shaped surface and the insulation means for spacing the insulation means from the shaped surface; and (e) the spacing plate means includes a base adapted for location over the shaped surface, and protrusions extending from the base and capable of engaging the insulation means, thereby forming an air space between the base of the spacing plate means and the insulation means.

2. A diffuser means for interfacing a duct with an area to be serviced by the duct, the diffuser means comprising:

(a) a housing having a shaped, contoured surface and including a substantially centrally disposed collar for engaging portions of the duct and terminating edge portions for interfacing with the area to be serviced;

(b) insulation means positioned on the shaped surface and extending between the collar and the terminating edge portions of the housing;

(c) wherein the contoured surface is a curvilinear surface including at least one node point located intermediate the collar and ther terminating edge portions of the housing;

(d) the shaped surface and the insulation means meet at the node point, so that air spaces are developed between other portions of the shaped surface and the insulation means; and (e) the shaped surface forms at least one other node point, and further comprising plate means attached to and extending between the other node point and portions of the housing adjacent the collar, thereby forming an additional air space between the plate means and the node point which meets the insulation means.

3. A diffuser means for interfacing a duct with an area to be serviced by the duct, the diffuser means comprising:

(a) a housing having a shaped, contoured surface and including a substantially centrally disposed collar for engaging portions of the duct and terminating edge portions for interfacing with the area to be serviced;

(b) insulation means positioned on the shaped surface and extending between the collar and the terminating edge portions of the housing;

(c) wherein the contoured surface in curvilinear surface including at least one node point located intermediate the collar and the terminating edge portions of the housing;

(d) spacing plate means interposed between the shaped surface and the insulation means for spacing the insulation means from the shaped surface; and (e) the spacing plate means includes a base adapted for location over the node point of the shaped surface, and protrusions extending from the base and capable of engaging the insulation means, thereby forming an air space between the shaped surface and the base of the spacing plate means, and the base of the spacing plate means and the insulation means.

* * * * *